US006931820B2

(12) United States Patent
Delisle

(10) Patent No.: US 6,931,820 B2
(45) Date of Patent: Aug. 23, 2005

(54) TRANSVERSE DIRECTION ZIPPER APPLICATOR AND METHOD

(75) Inventor: Victor Delisle, Roswell, GA (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/366,164

(22) Filed: Feb. 13, 2003

(65) Prior Publication Data

US 2003/0115832 A1 Jun. 26, 2003

Related U.S. Application Data

(62) Division of application No. 09/885,238, filed on Jun. 20, 2001, now Pat. No. 6,553,740.

(51) Int. Cl.[7] ..... B65B 9/20; B65B 61/18
(52) U.S. Cl. ..... 53/412; 53/451; 493/213
(58) Field of Search ..... 53/412, 133.4, 53/139.2; 156/66

(56) References Cited

U.S. PATENT DOCUMENTS 4,878,987 A * 11/1989 Ven Erden ..... 156/66
5,816,018 A 10/1998 Bois ..... 53/133.4
6,044,621 A 4/2000 Malin et al. ..... 53/412
6,116,314 A * 9/2000 Johnson ..... 383/66
6,138,436 A * 10/2000 Malin et al. ..... 53/133.4
6,568,150 B2 * 5/2003 Forman ..... 53/133.4
6,588,176 B1 * 7/2003 Buchman ..... 53/412

FOREIGN PATENT DOCUMENTS

EP 1 086 899 3/2001
WO 99/59872 11/1999

* cited by examiner

*Primary Examiner*—John Sipos
(74) *Attorney, Agent, or Firm*—Pitney Hardin LLP

(57) ABSTRACT

An apparatus for attaching discrete lengths of zipper at spaced intervals across a web of bag making film has an endless belt supported between a pair of pulleys for moving zipper segments into position on the web. The zipper segments are cut from a zipper supply and fed into a nip between the endless belt and the web top surface. After a zipper segment is deposited into position on the web, the endless belt is raised. A vertically movable sealing bar below the web is raised into position to heat the web to seal the zipper to the web after which the sealing bar is lowered. The web then advances and the process is repeated.

3 Claims, 2 Drawing Sheets

58
44
50
36
56
52

66
68
70
72
46
30
40
48
34
50
60
43
36
32
38
44
52

64
30
52
34
36
44
48
32
50
60
36
42
61
62
48
44
74
44
44

TRANSVERSE DIRECTION ZIPPER APPLICATOR AND METHOD

CROSS REFERENCE TO RELATED APPLICATIONS

This is a division of U.S. patent application Ser. No. 09/885,238 filed on Jun. 20, 2001 now U.S. Pat. No. 6,553,740.

BACKGROUND OF THE INVENTION

In U.S. Pat. No. 4,909,017 a method is disclosed for producing a reclosable plastic bag having a zipper that extends transverse to the longitudinal or running direction of the web of the film from which the bag is formed. In accordance with the disclosed method which is illustrated in simplified form FIG. 1 of the present application, a zipper segment 10 having interlocked profiles is fed transversely across a web of bag making film 12 and one of the profiles is attached to the web. The length of the segment is equal to approximately half the width of the desired bag. At a bag making machine the web is formed into a tube by sealing the edges of the film together with seal bars 14 after which the other profile of the zipper is attached to an inner surface of the tube by seal bar 16*s*. The construction of bag 21 is completed by forming a cross seal 18 by seal bar 20 which also serves to sever the completed bag from the tube.

In U.S. Pat. No. 6,116,314 problems associated with attaching a zipper transverse to the running direction of a bag making film are discussed. In this patent and other relatively recently issued patents, the problems of attaching transverse direction zipper are addressed by providing the zipper profiles with extended flanges to facilitate the attachment process. In many instances, however, it is desirable to use a flangeless zipper or a zipper with limited flanges. For one thing, such zippers utilize less plastic and hence tend to be cheaper than zipper with flanges. In addition, because of their smaller size, greater lengths of flangeless or limited-flange zipper can be wound on comparably sized rolls as compared with flanged zipper which enables longer production runs.

SUMMARY OF THE INVENTION

The present invention relates to a method and apparatus for attaching zipper to film that can be used with virtually any type of zipper profiles. That is, the zipper profiles may be flanged, flangeless or anything in between. In accordance with the present invention, an apparatus for attaching discrete lengths of zipper at spaced intervals across a film has an endless belt supported between a pair of pulleys for moving a zipper segment onto a web of bag making film moving along a path off a supply roll. The zipper consists of profiles with interlocked engagement elements and is fed with one profile atop the other. The zipper segments are cut from a zipper supply and fed into a nip between the endless belt and the web top surface. After a zipper segment is deposited into position on the web, the pulleys are raised to disengage the zipper segment from being driven further by the endless belt. A sealing bar below the web is then raised into position to heat the bottom surface of the web to seal the bottom profile of the zipper to the web top surface after which the sealing bar is lowered. The web then advances and the process is repeated. The resultant bag making film with attached zipper may then be fed directly into a bag making machine or spooled for later use.

DETAILED DESCRIPTION OF THE PREFERRED EMBODIMENT

Figures 2, 3, 4:
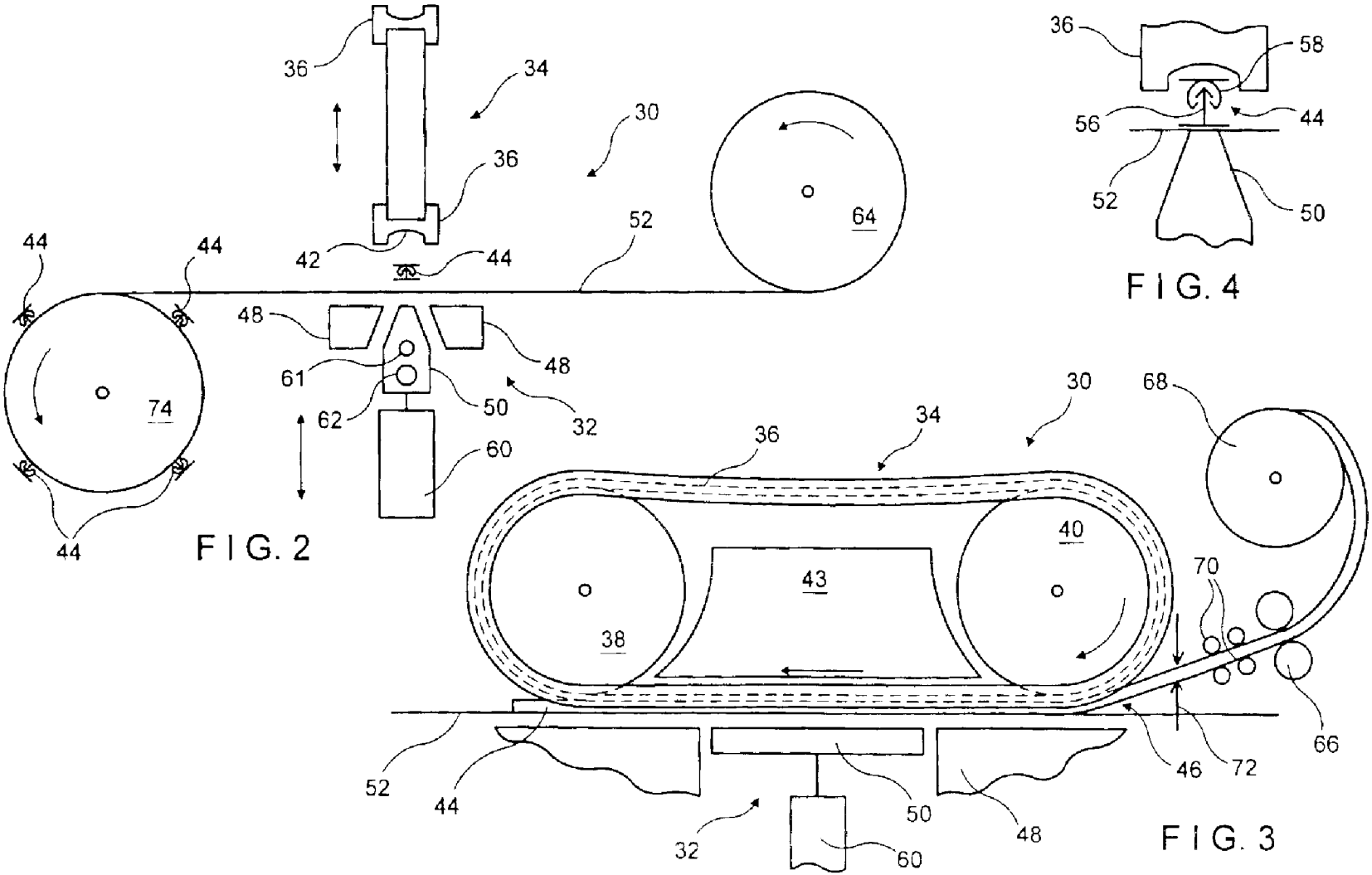
FIG. 2 is a schematic side elevational view of a zipper-to-web applicator in accordance with the present invention.
FIG. 3 is a schematic sectional view taken along reference line 3—3 of FIG. 2.
FIG. 4 is a fragmented view similar to FIG. 3 showing the seal bar in sealing position.

Reference is now made to the drawings and to FIGS. 2 and 3 in particular wherein the zipper-to-web applicator 30 of the present invention is depicted. The applicator 30 consists of two main sections, a zipper sealer 32 and zipper drive 34. The zipper drive 34 consists of an endless belt 36 formed of silicon rubber or the like extending about a pair of pulleys 38, 40. One of the pulleys is connected to a drive (not shown) to be driven as indicated in FIG. 3. The zipper drive 34 is also vertically shiftable between a lower position as shown in FIGS. 3 and 4 and a raised position that is shown in FIG. 2. The belt has a concave contour 42 on its outer surface into which a zipper segment 44 fits. A block of a heat resistant material 43 such as nylon or Delrin is provided within the belt, between the pulleys. When in the lower position, the belt forms a nip 46 with the top surface of a web of film seated on the applicator frame 48 so that a segment of zipper 44 fed into the nip is drawn by the belt across the web, as will be described.

The zipper sealer 32 consists of a seal bar 50 that is vertically movable by a two stage cylinder 60 between a lower position shown in FIG. 2 and a raised position shown in FIG. 4. When in the lower position, the seal bar is out of contact with the bottom surface of a web 52 on a support surface of the applicator and spaced sufficiently far beneath the web so that it does not affect the web 52. In the raised position (shown in FIG. 4), the sealing bar contacts the web bottom surface and seals the bottom of the lower profile 56 of zipper 44 to the top surface of the film web. To this end, the bottoms of the zipper profiles 56, 58 may be coated with a sealant layer, such as EVA, to facilitate sealing the zipper to the bag making film. A thermocouple 61 and heater element 62 are provided in the seal bar 50 in the conventional manner to control the temperature for optimum sealing.

Figure 1:
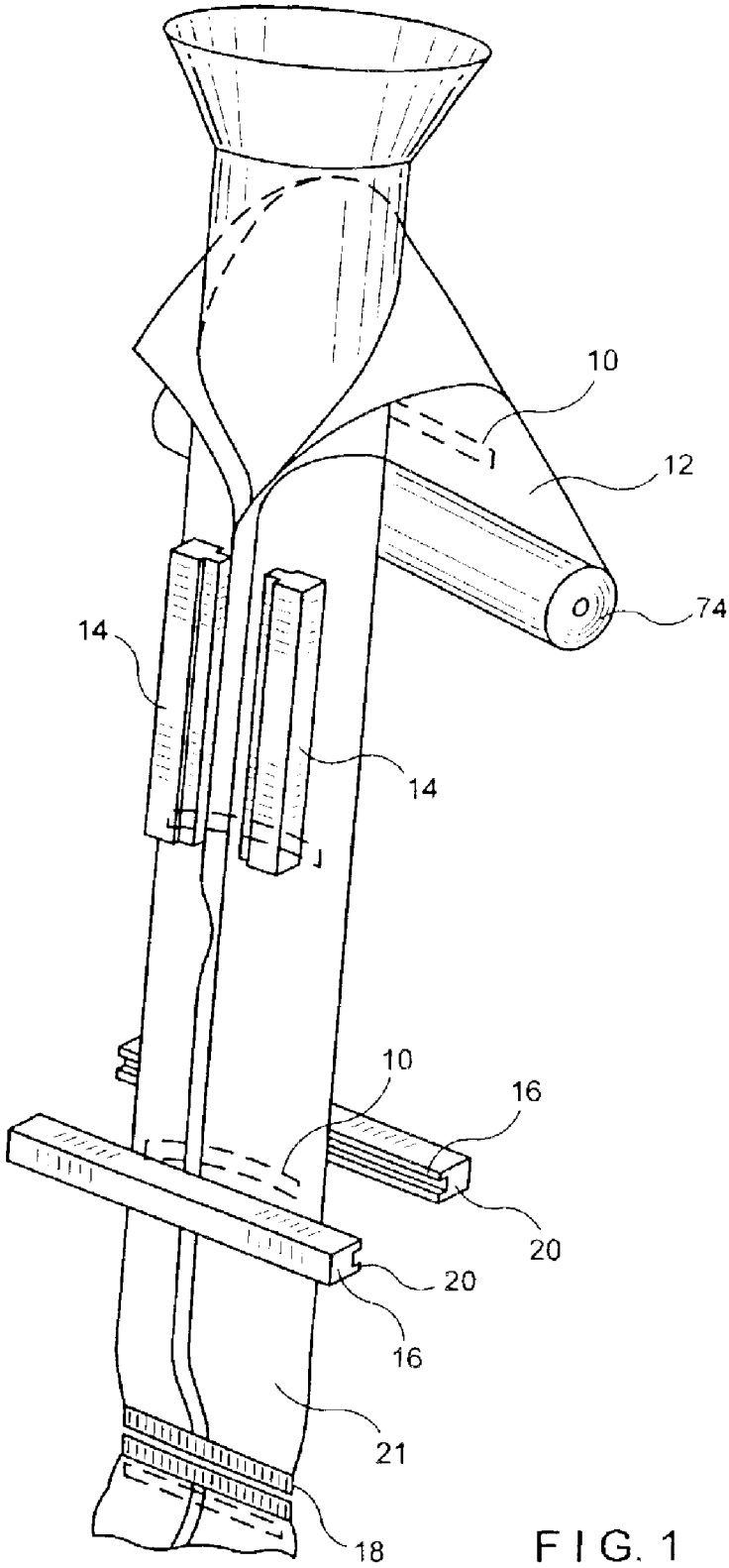
FIG. 1 PRIOR ART
FIG. 1 is a schematic representation of a system for producing reclosable bags from a web of bag making film having zipper segments applied transversely to the running direction of the web.

In operation a web of bag making film 52 is fed off a feed spool 64 onto a support surface 48 of the applicator. The web feed may be continuous or intermittent. If continuous, dancer rolls or a similar arrangement may be used to enable the web at the applicator to be stopped during the zipper application process. When a desired length of bag making film (determined by the depth of the bag 21 to be formed) is fed onto the applicator support surface, the web is stopped and zipper drive 34 is lowered. Drive pulley 40 is then activated to move belt 36. A drive arrangement 66 is also activated to draw zipper from a zipper supply spool 68 through guides 70 to the nip 46 between the entrance to the zipper drive 34 and the web seated on support surface 48. When a sufficient length of zipper is drawn (i.e. a length equal to approximately one half the width of web 52), cutter 72 is activated to sever the zipper length from the zipper supply. The zipper length is then moved by the lower portion of endless belt 36 into the desired position on web 52 (usually centered with respect to the edges of the web) and the zipper sealer cylinder 60 is activated to raise seal bar 50. The heated seal bar 50 then seals the bottom of the bottom profile 56 of the zipper to the top surface of web 52 by capturing the two between the seal bar and the belt which is supported by the heat resistant block 43. The zipper sealer 32 is then lowered, the zipper drive 34 is raised and a take up spool 74 is activated to move the film 52 into the next position to receive a zipper and the process is then repeated. The spool 74, which consists of the web of bag film with attached zipper is then brought to a bag making machine such as depicted in FIG. 1 to complete the bag making process.

Thus, in accordance with the above, the desired objectives of the present invention are effectively attained. It should be understood that modifications of the preferred embodiment will be readily apparent to those skilled in the art. For example, rather than spooling the web of bag making film with attached zipper, the zipper applicator may be placed upstream of the bag making equipment so that the film web with applied zipper can be fed directly into the bag making equipment. Also, rather than intermittently stopping the film for each zipper length application, the zipper applicator may be fixed to a shuttle that moves with the film during zipper application and then moves back to the zipper receiving position.

Having thus described the invention, what is claimed is:

1. A method for attaching discrete lengths of zipper segments having interlocked profiles at spaced intervals across a web of bag making film, one of said profiles being atop the other, said method comprising:

moving said web along a feed path;

moving a zipper segment onto a top surface of said web extending at least partially across said web, by a driven belt transverse to the web moving direction;

heating said web from below a bottom surface by capturing said web and zipper segment against said belt of said web so as to seal substantially an further comprising the;

wherein said zipper segment is moved by a driven endless belt and comprising the further steps of feeding a zipper to a cutter, at said cutter removing a zipper segment from said zipper and downstream of said cutter feeding said segment into a nip between said endless belt and said web top surface.

2. The method in accordance with claim 1 comprising the further step of moving said driven endless belt vertically away from said web top surface after moving said zipper segment into position on said web top surface.

3. The method in accordance with claim 1 comprising the further step of moving said sealing bar downwardly from said web bottom surface after sealing said zipper segment to said web.

* * * * *